United States Patent [19]

Inoue et al.

[11] Patent Number: 5,022,775

[45] Date of Patent: Jun. 11, 1991

[54] WRITING INPLEMENT WITH MAGNETIC CLOSURE

[75] Inventors: Shigeyasu Inoue; Tatsuya Ozu; Yasunori Nakatani, all of Osaka, Japan

[73] Assignee: Kabushiki Kaisha Sakura Kurepasu, Osaka, Japan

[21] Appl. No.: 562,047

[22] Filed: Aug. 2, 1990

[30] Foreign Application Priority Data

Aug. 9, 1989 [JP] Japan ..... 1-94208[U]
Jul. 31, 1990 [JP] Japan ..... 2-204267

[51] Int. Cl.[5] ..... B43K 9/00
[52] U.S. Cl. ..... 401/107; 401/108
[58] Field of Search ..... 401/107, 108

[56] References Cited

U.S. PATENT DOCUMENTS 3,427,112 2/1969 yanagisawa et al. ..... 401/107

FOREIGN PATENT DOCUMENTS 4283 1/1967 Japan .

*Primary Examiner*—Steven A. Bratlie
*Attorney, Agent, or Firm*—Jordan and Hamburg

[57] ABSTRACT

A writing implement having a sleeve formed with a bore extending therethrough axially of the implement, a barrel inserted in the bore of the sleeve and retractably projectable forward from the forward end of the sleeve, and a closure so shaped as to close the forward end opening of the sleeve bore. At least the forward end portion of the sleeve and the closure are made of a magnetic material, and at least one of the sleeve forward end portion and the closure is formed by a magnet so as to attract the other. The closure is connected to the sleeve by a connecting member made of an elastic material so as to be movable between a position where the closure closes the forward end opening of the sleeve bore and a position where the closure opens the forward end opening to permit the barrel to project forward. The closure is biased by the connecting member toward the sleeve to a position where the closure is attractable by the sleeve.

29 Claims, 10 Drawing Sheets

10
12
14
16
18
22
24
141
143
181
182
183
221
222
223
241
242
243
244
245
246

WRITING INPLEMENT WITH MAGNETIC CLOSURE

BACKGROUND OF THE INVENTION AND RELATED ART STATEMENT

The present invention relates to writing implements including ballpoint pens, cosmetic applicators, marking pens such as sign pens, plastic pens, paint markers, etc.

Conventional writing implements are adapted to prevent the ink from drying by closing the forward end of the implement with a cap while the implement is not in use. However, implements of the type having the cap are inefficient to use, while the cap is likely to become lost. Accordingly, writing implements are developed in recent years which are adapted to automatically close the forward end when brought out of use to eliminate the need for the cap.

For example, Examined Japanese Utility Model Publication SHO No. 42-21538 and Unexamined Japanese Utility Model Publication SHO No. 62-87882 disclose writing implements which comprise a sleeve formed by a magnet and disposed at a forward end portion of the body of the implement, a forward end portion of a barrel including a writing nib and an ink reservoir, such as ballpoint pen refill, retractably projectable forward from the sleeve through a bore extending therethrough, and a closure in the form of a ball or plate and magnetically attractable to the forward end face of the sleeve to close the bore with the closure when the forward end portion of the barrel is in its retracted position. Thus, the writing liquid inside the implement can be automatically prevented from evaporating with the closure without using a cap or the like.

Examined Japanese Utility Model Publications SHO No. 38-18620 and SHO 41-13855 disclose an arrangement wherein the closure is connected to the sleeve by an elastic member, which presses the closure into contact with the forward end face of the sleeve with its elastic force to close the sleeve bore.

However, with the writing implements disclosed in the Examined Japanese Utility Model Publicaiton SHO No. 42-21538 and the Unexamined Japanese Utility Model Publication SHO No. 62-87882, the closure is attracted to the sleeve, only with the magnetic force of the sleeve, so that it is likely that the closure will not fully return to the original closing position, failing to completly close the bore, for example, after the closure is raised through more than 90 degrees when the forward end portion of the barrel is projected forward, or when the barrel is retracted to its stowed position with the implement directed downward. Especially when the barrel is moved forward with the forward end of the implement directed downward, the closure forced away from the sleeve is likely to close the forward end opening of the implement to thereby impede the projection of the barrel end. If the implement is forcibly projected, a great load will act on the barrel end to result in a break.

On the other hand, with the writing implements disclosed in Utility Model Publications SHO No. 38-18620 and SHO 41-13855, the closure is pressed against the sleeve with the elastic restoring force of the elastic member, so that a considerably great restoring force is required of the elastic member to completely close the implement. In the case of the disclosed arrangement, therefore, the barrel end, when to be projected, encounters great resistance offered by the elastic member.

Since this resistance increases as the elastic member deforms to a greater extent, an increased load acts on the tip of the implement to break the tip. Conversely, when the elastic restoring force of the elastic member is small, the implement is not closed completely. Consequently, the enclosing space of the sleeve, in which the forward end portion of the barrel is placed, cannot have a desired vapor pressure. This leads to a problem that a greater amount of ink evaporates from the forward end portion of the barrel, and blurred writing occurs.

SUMMARY OF THE INVENTION

An object of the present invention is to provide a writing implement which is free of the above problems.

To fulfill this object, the present invention provides a writing implement having a sleeve formed with a bore extending therethrough axially of the implement, a barrel inserted in the bore of the sleeve and retractably projectable forward from the forward end of the sleeve, and a closure so shaped as to close the forward end opening of the bore of the sleeve. At least the forward end portion of the sleeve and the closure are made of a magnetic material, at least one of the sleeve forward end portion and the closure being formed by a magnet to attract the other, the closure being connected to the sleeve by a connecting member made of an elastic material so as to be movable between a position where the closure closes the forward end opening of the sleeve bore and a position where the closure opens the forward end opening to permit the barrel to project forward, the closure being biased by the connecting member toward the sleeve to a position where the closure is attractable by the sleeve.

When the forward end portion of the barrel is positioned as retracted in the sleeve, the closure is held magnetically attracted to the forward end face of the sleeve, whereby the forward end opening of the sleeve is held closed with the closure.

When the forward end portion of the barrel is projected forward from this state, the closure is forced away from the sleeve by the tip of the barrel, rendering the implement ready for writing. At this time, the closure, which is connected to the sleeve by a connecting member, will not be brought to an objectionable position as separated from the sleeve. On the other hand, the connecting member needs only to have such an elastic force as to urge the closure to a position in the vicinity of the sleeve, with the result that the load acting on the barrel tip when the forward end portion of the barrel is projected is smaller than in the writing implement wherein the closure is pressed against the sleeve by the elastic force of the connecting member.

When the forward end portion of the barrel is stowed inside the sleeve from this state, the closure is returned to the position close to the sleeve by the elastic restoring force of the connecting member and further held in position to close the forward end opening of the sleeve by the attracting force of the sleeve.

According to the present invention, therefore, the writing implement can be hermetically closed reliably, and when the barrel is moved from the projected position to the stowed position, the elastic force of the connecting member reliably moves the closure to the position where the closure is attractable by the sleeve. Moreover, when the barrel is moved from the stowed position to the projected position, the connecting member needs only to have such an elastic restoring force as to urge the closure to the above-mentioned position. Thus, the present implement has the advantage that the load acting on the tip of the barrel when the forward end portion of the barrel is projected can be smaller than in the conventional arrangement wherein the closure is pressed into contact with the sleeve by the elastic force of the connecting member.

The above and other objects, features and advantages of the present invention will become more apparent upon a reading of the following description with reference to the drawings.

BRIEF DESCRIPTION OF THE DRAWINGS

FIG. 3(*b*) is a sectional view showing the barrel in a projected position;

FIG. 5(*b*) is a sectional view showing the barrel in a projected position;

FIG. 6(*b*) is a sectional view showing the barrel in a projected position;

FIG. 8(*b*) is a sectional view showing the barrel in a projected position;

FIG. 10(*b*) is a sectional view showing the barrel in a projected position;

FIG. 11(*b*) is a sectional view sowing the barrel in a projected position.

DESCRIPTION OF THE PREFERRED EMBODIMENTS

Figure 1:
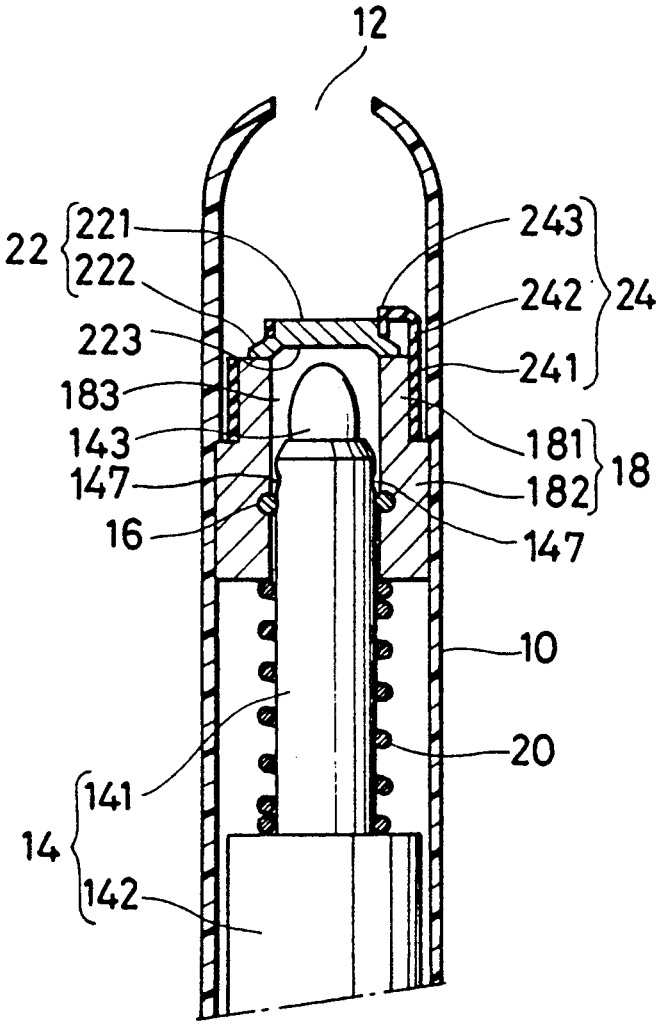
FIG. 1 is a fragmentary view in section of a writing implement as a first embodiment of the invention.

A first embodiment of the present invention will be described with reference to FIGS. 1 to 4. The illustarated writing implement has a container 10 as its body. The container 10 is made of plastic material or the like. The container 10 is formed with an opening 12 at its forward end and has accommodated therein a refill (barrel) 14 movably axially of the container. The refill comprises a forward barrel 141 having a relatively small diameter and a tail barrel 142 of a large diameter. The forward barrel 141 has a writing tip 143 at its forward end.

Figure 2:
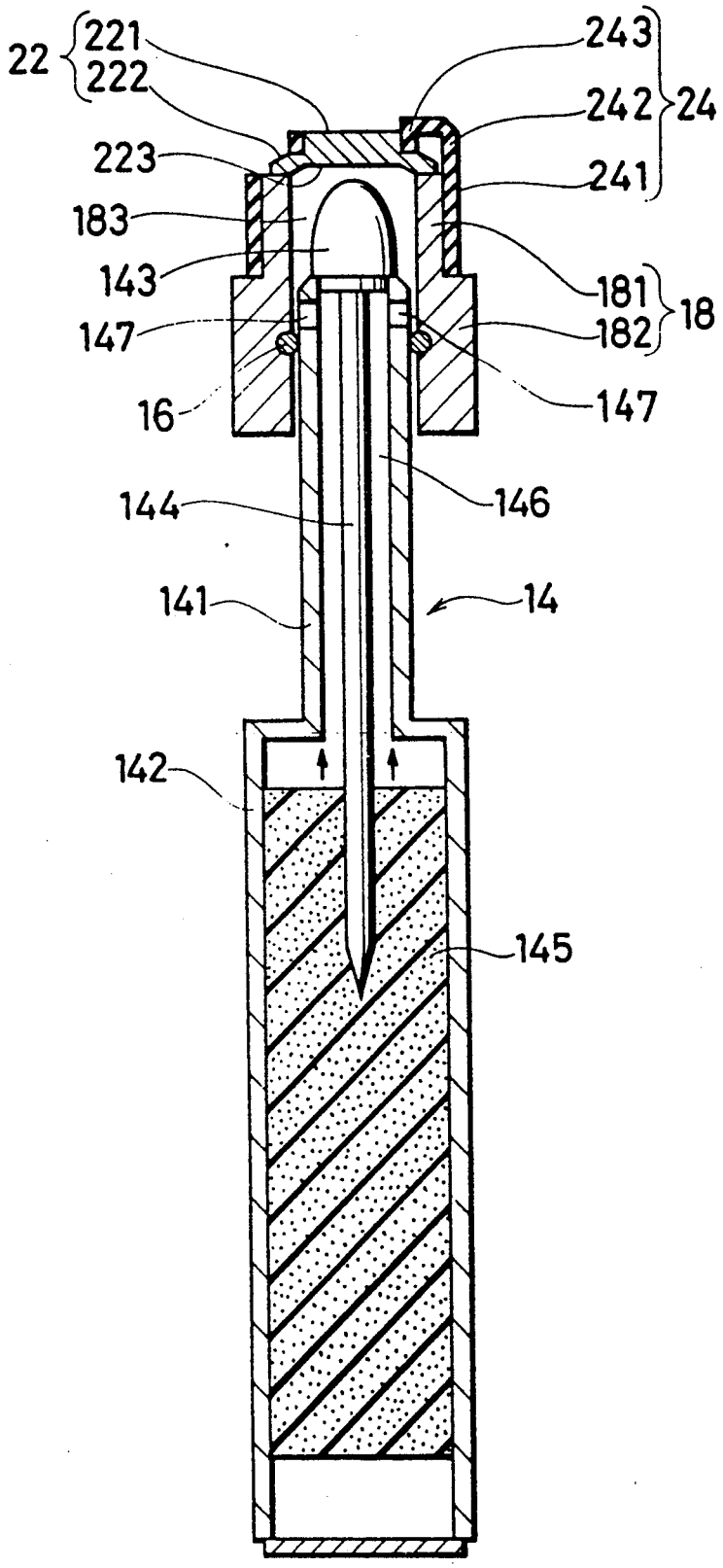
FIG. 2 is a sectional view showing an internal structure of a refill of the writing implement.

As shown in FIG. 2, the writing tip 143 is communicated with an ink absorber 145 contained in the tail barrel 142 through a small diameter portion 144 extending axially of the forward barrel 141. The ink absorber 145 constitutes an ink storage portion of the writing implement. It should be noted that for the ink storage portion, an ink reservoir for containing ink may be used in place of the ink absorber 145.

A sleeve 18 made of stainless steel or like magnetic material is fixedly fitted in the container 10 at a position close to its forward end. The sleeve 18 comprises a small-diameter portion 181 positioned toward the forward end (toward the top in FIGS. 1, 2, 3(*a*) and 3(*b*)), and a large-diameter portion 182 toward the tail end. A bore 183 extends through both portions 181, 182 at the center axially of the writing implement. The forward barrel 141 is inserted in the bore 183 of the sleeve 18 and is retractably projectable from the forward end face (upper end face in FIG. 1) of the sleeve 18. A seal member 16 in the form of an O-ring or the like is secured to the inner surface of the sleeve 18. The contact of the seal member 16 with the forward barrel 141 holds the interior of the bore 183 of the sleeve 18 hermetically closed.

Figures 3A, 3B:
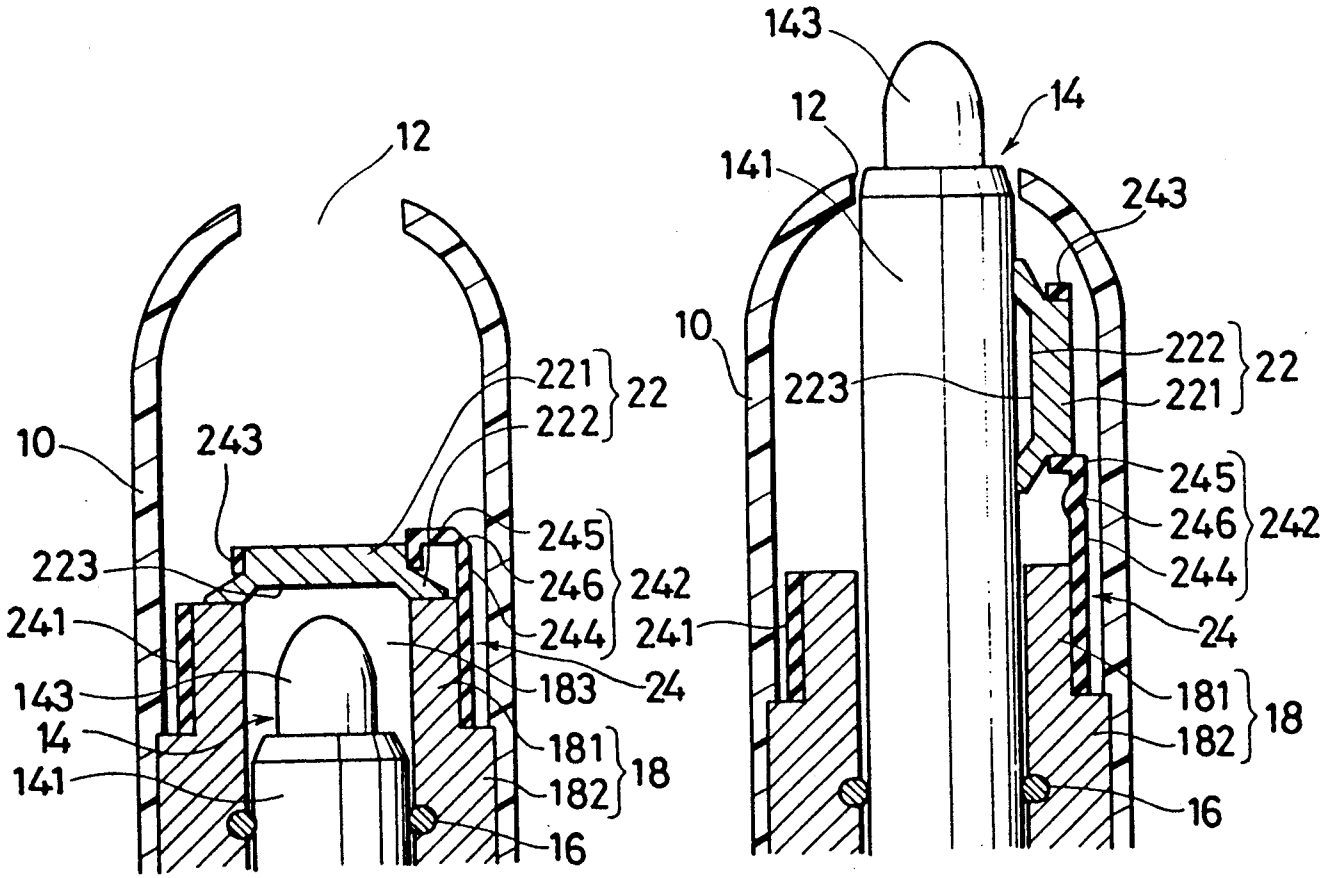
FIG. 3(*a*) is a sectional view showing the barrel of the implement in a stowed position.

A compression spring 20 for biasing the refill 14 toward the tail end is provided between the rear face of the sleeve 18 and the forward end of the tail barrel 142. The rear portion of the refill 14 is connected to an unillustrated knocking mechanism, whereby the refill 14 is retained alternately in a stowed position with its forward end retracted in the sleeve 18 as seen in FIG. 3(*a*) and in a projected position wherein the refill forward end is projected outward from the opening 12 as shown in FIG. 3(*b*).

The writing implement has a closure 22 formed by a magnet and connected to the forward end portion of the sleeve 18 by a connecting member 24 made of a rubber or like elastic material. The closure 22 comprises an upper portion 221 in the form of a solid cylinder, and a lower portion 222 extending downward from the upper portion 221 in a flaring form. The lower portion 222 is substantially larger at its bottom than the bore 183 to completely close the forward end opening of the bore 183. A recess 223 generally in conformity with the bore 183 is formed in the lower face of the closure.

The connecting member 24 has a lower fitting portion 241 in the form of a tube of large diameter, and an upper fitting portion 243 in the form of a tube of small diameter and connected to a portion of the upper end of the lower fitting portion 241 by a connector 142. The lower fitting portion 24 is fitted around the small-diameter portion 181 of the sleeve 18, and the upper fitting portion 243 is fitted around the upper portion 221 of the closure 22, whereby the closure 22 is connected to the sleeve 18.

Figure 4:
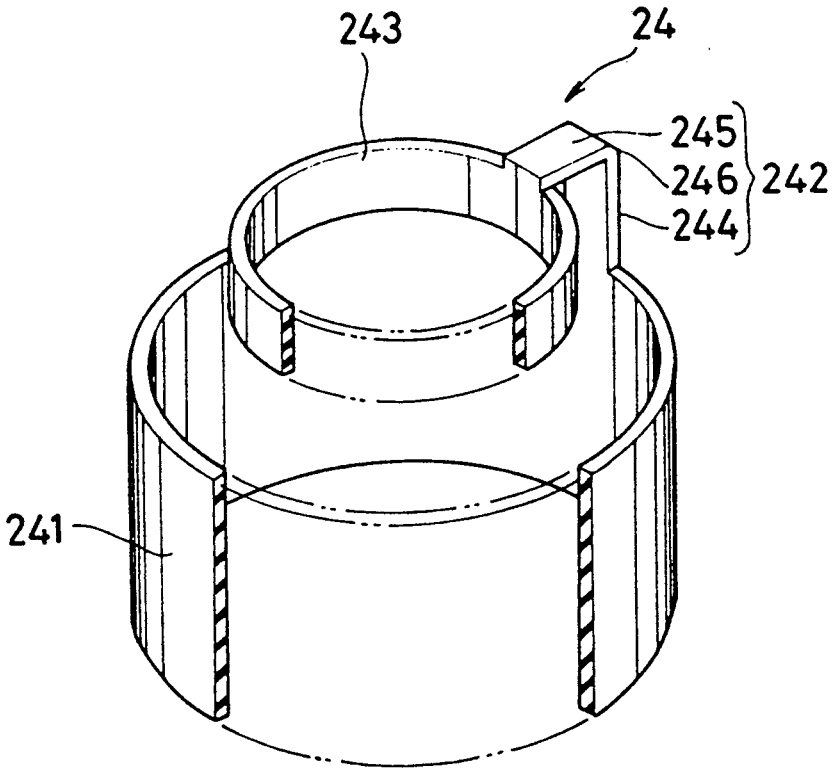
FIG. 4 is a perspective view partly broken away and showing a connecting member incorporated in the writing implement.

As seen also in FIG. 4, the connector 242 comprises an upward portion 244 extending upward from the upper end of the lower fitting portion 241, and an inward portion 245 extending inward from the upper end of the upward portion 244. The upper fitting portion 243 is integral with the inner end of the inward portion 245. The junction of the upward portion 244 and the inward portion 245 is a corner portion 246 having a tapered face 246. The connector 242 is flexible at the corner portion 246 to move the closure 22 between a closing position in which the closure closes the forward end opening of the bore 183 of the sleeve 18 as shown in FIG. 3(*a*) and a position away from the forward end face of the sleeve 18 as shown in FIG. 3(*b*). The corner portion 246 is so formed that the upward portion 244 and the inward portion 245 are approximately at a right angle with each other when free of any external force. The connector 242 urges with its elastic restoring force the closure 22 toward the sleeve 18 to a position in the vicinity of the forward end face of the sleeve 18, i.e., to a position where the closure 22 is magnetically attractable by the sleeve 18.

On the other hand, as shown in FIG. 2, air passage holes 147 are formed in a forward end wall of the forward barrel 141 of the refill 14. The air passage holes 147 are adopted for communicating the inside of the forward barrel 141 with the outside. When the refill 14 is capped, the closing space of the sleeve 18, being hermetically closed by the closure 22 and the seal member 16, is communicated with the space of the refill 14 containing the ink absorber 145 through the air passage holes 147 and an air passage 146 between the forward barrel 141 and the small diameter portion 144.

The operation of the writing implement will be described next.

First, while the refill 14 is retained in the stowed position as shown in FIG. 3(*a*), the closure 22 is held in a position closing the bore 183 by being attracted by the sleeve 18, whereby the bore 183 of the sleeve 18 is sealed off.

When the refill 14 is pushed forward from this state by actuating the knocking mechanism, the closure 22 is brought to an upright position as shown in FIG. 3(*b*) by being pushed by the tip of the refill 14 (writing tip 143), and the refill 14 itself is also retained in the projected position and made ready for writing. Since the connector 242 of the connecting member 24 is greatly deformed at this time from the spontaneous state in which the upward portion 244 and the inward portion 245 are approximately at a right angle with each other, the closure 22 is biased toward the original position by the elastic restoring force of the connector 242. Although the writing tip 143 is subjected to a load due to the biasing force when the refill 14 is projected, the restoring force of the connecting member 24 is merely such that the closure is urged to a position close to the forward end face of the sleeve 18. Accordingly, the load is smaller than in the conventional arrangement wherein the closure 22 is pressed into contact with the sleeve 18 by the elastic restoring force of the connecting member 24. The writing tip 143 can therefore be precluded from breaking.

After the writing implement is used, the knocking mechanism is actuated again to return the refill 14 to the stowed position. This permits the elastic restoring force of the connecting member 24 to return the closure 22 to the position close to the forward end face of the sleeve 18 first. The closure 22 is then intimately contacted with the sleeve end face by being magnetically attracted by the sleeve 18. The closure 22 thus held in position closes the forward end opening of the bore 183 to close the bore, so that vapor supplied to the closing space of the sleeve 18 from the ink absorber 145 is prevented from diminishing.

Thus, in the case of the present writing implement, the bore 183 of the sleeve 18 can be sealed by causing the sleeve 18 to magnetically attract the closure 22, and the closure 22 is connected to the sleeve 18 by the connecting member 24 and is thereby made movable to a regulated position properly. Further because the elastic restoring force of the connecting member 24 is relatively small, the load acting on the writing tip 143 when the refill 14 is projected is small. This precludes the writing tip 143 or the like from breaking.

Further according to the present embodiment, the closure 22 is formed at a suitable portion thereof with the recessed portion 223 for the writing tip 143 to come into contact with. This results in the advantage of obviating the likelihood that the writing liquid will adhere to the sealing portion, i.e., the peripheral edge around the recess 223, to impair the sealing effect.

A second embodiment will be described next with reference to FIGS. 5(*a*) and 5(*b*).

Figure 5:
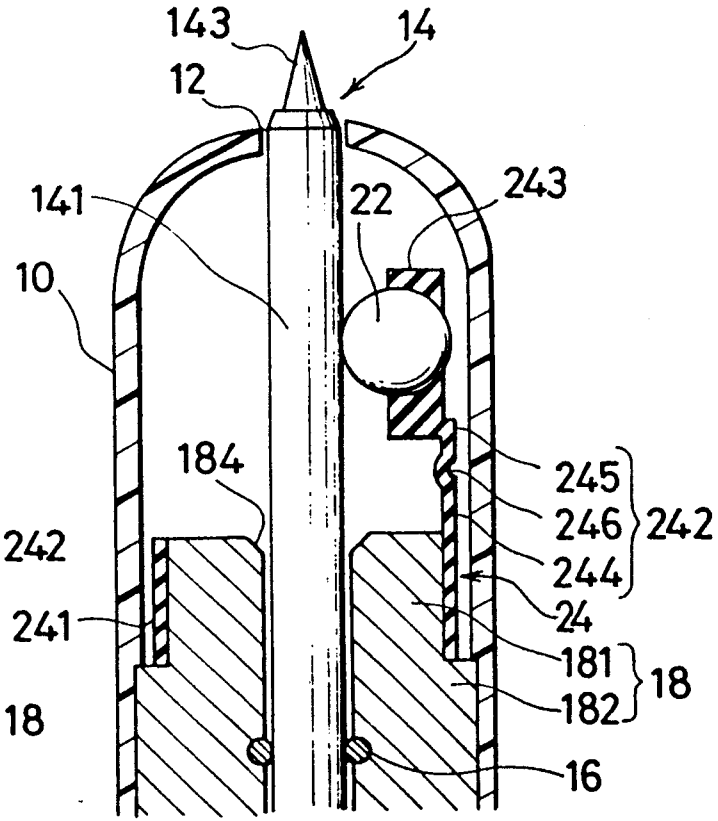
FIG. 5(*a*) is a sectional view showing another writing implement as a second embodiment with its barrel in a stowed position.
Figure 5:
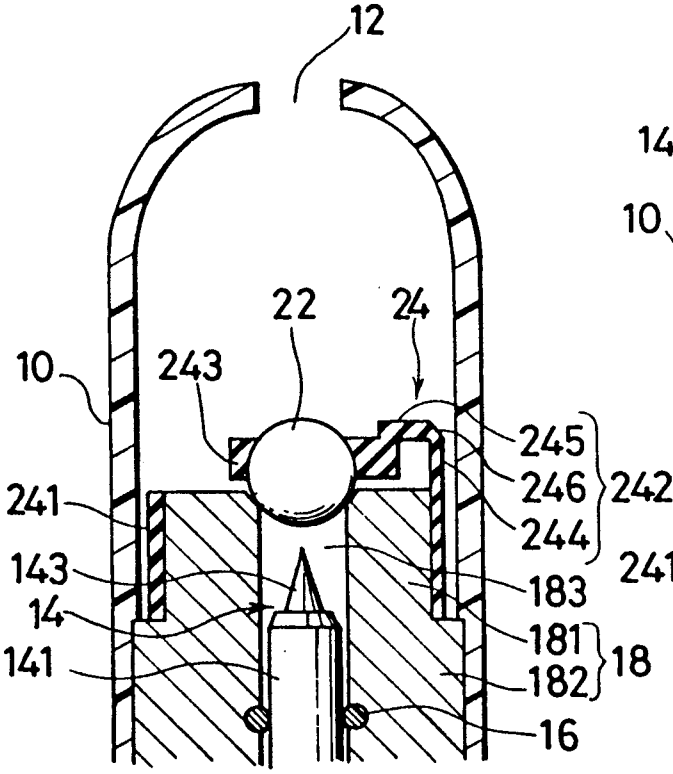

The closure 22 of this embodiment is a rigid ball of magnet, and the peripheral edge of the sleeve 18 defining the forward end opening of the bore 183 is formed with a tapered face 184 (FIG. 5(*b*)). The contact of the closure 22 with the tapered face 184 closes the bore 183 of the sleeve 18. According to the present invention, the shape of the closure is not limited specifically but can be suitably determined in accordance with the construction of the writing implement as will be apparent from the present embodiment.

Figure 6B:
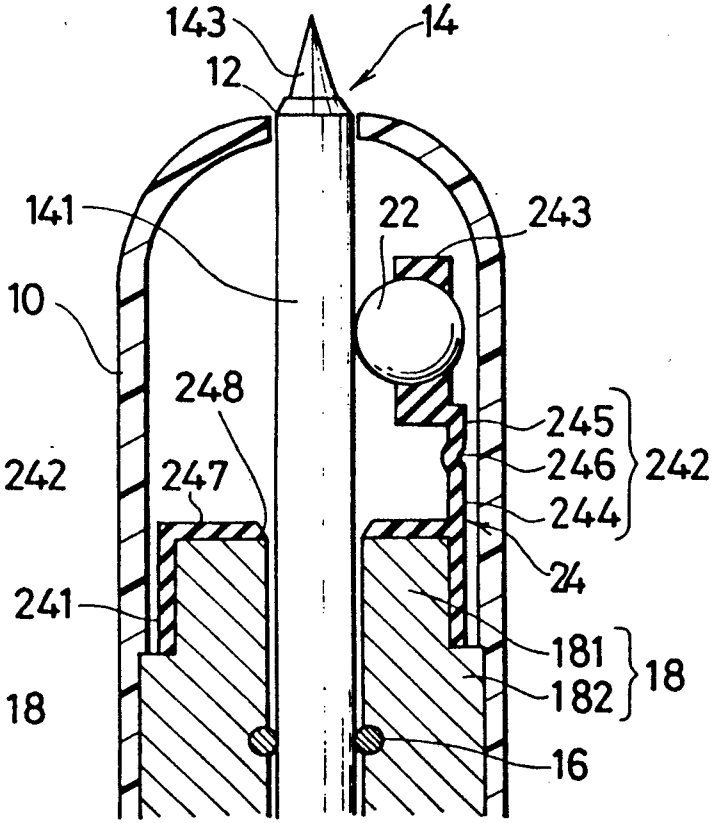
FIG. 6(*a*) is a sectional view showing another writing implement as a third embodiment with its barrel in a stowed position.
Figure 6A:
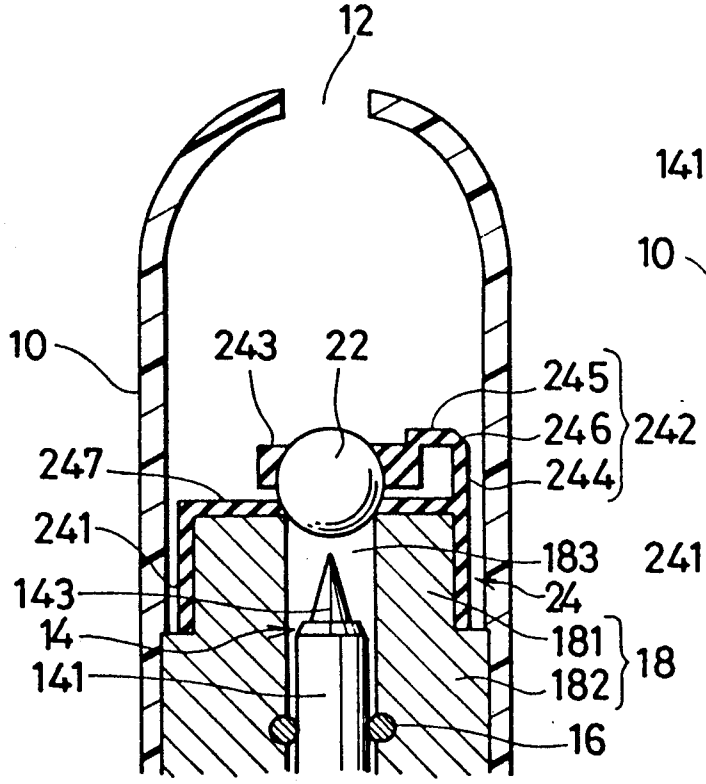
Figure 7:
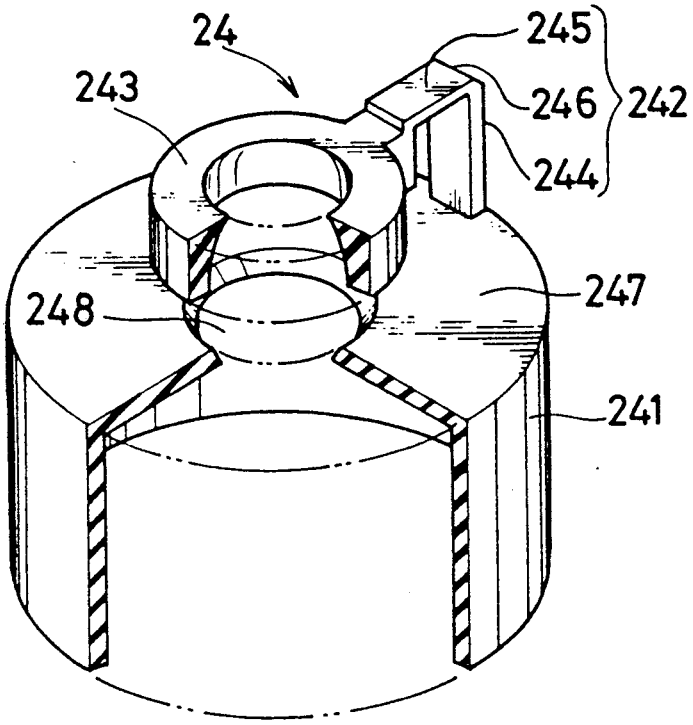
FIG. 7 is a perspective view partly broken away and showing a connecting member incorporated in the writing implement.

A third embodiment will be described next with reference to FIGS. 6(*a*) and 6(*b*) and FIG. 7.

In this embodiment, the lower fitting portion 241 of the connecting member 24 of the second embodiment is in the form of a cap having a top wall 247. This lower fitting portion 241 is fitted over the small-diameter portion 181 of the sleeve 18. The top wall 247 is centrally formed with a hole 248 in conformity with the bore 183 of the sleeve 18. The closure 22 comes into contact with a tapered surface formed along the top wall inner periphery defining the hole 248 to seal off the interior of the bore 183 of the sleeve 18.

With the construction described above, the closure 22 is attracted to the sleeve 18 by a magnetic force penetrating through the top wall 247, thereby intimately contacting the top wall 247 with the sleeve 18, whereby the bore in the sleeve 18 is sealed. According to the invention, the configuration of the connecting member is not limited specifically, nor is it always necessary for the closure to directly contact the sleeve as will be apparent from the present embodiment. Especially, the present embodiment wherein the closure 22 is adapted to come into contact with the top wall 247 of the relatively flexible connecting member 24 when the refill 14 is in its stowed position has the advantage of ensuring an improved sealing effect. The top wall 247 has such a small thickness that the magnetic force of the closure 22 will reach the sleeve 18.

Figure 9:
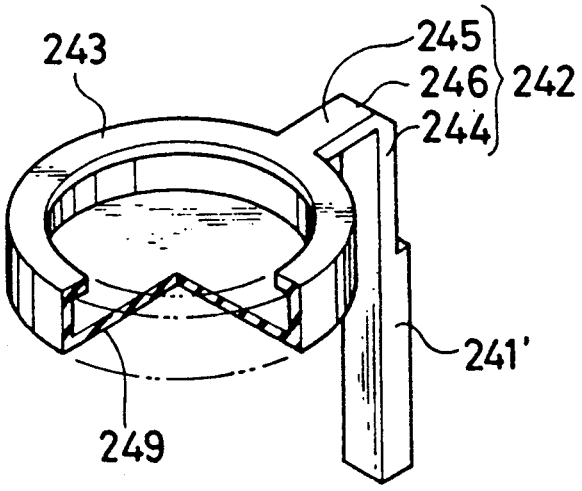
FIG. 9 is a perspective view partly broken away and showing a connecting member incorporated in the writing implement.
Figure 8B:
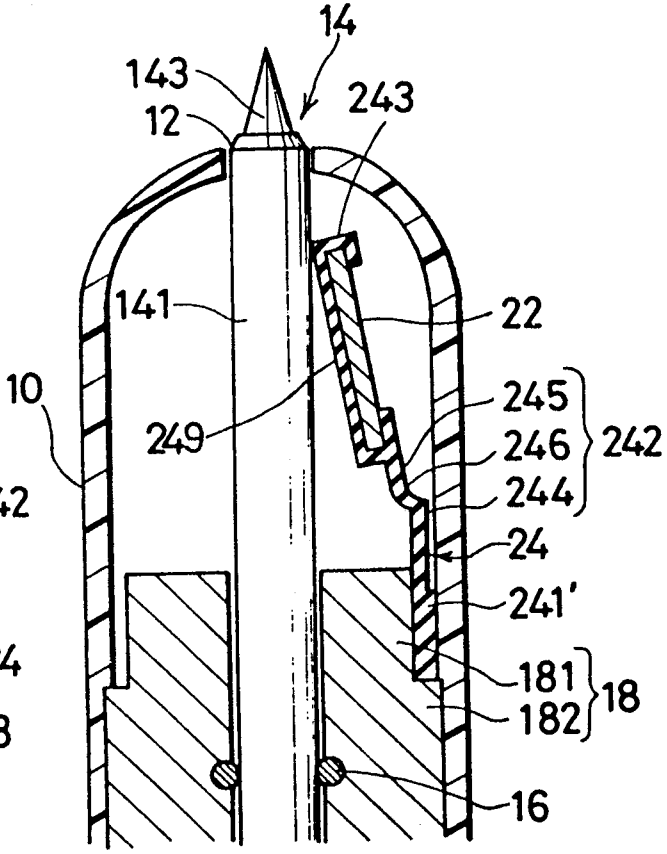
FIG. 8(*a*) is a sectional view showing another writing implement as a fourth embodiment with its barrel in a stowed position.
Figure 8A:
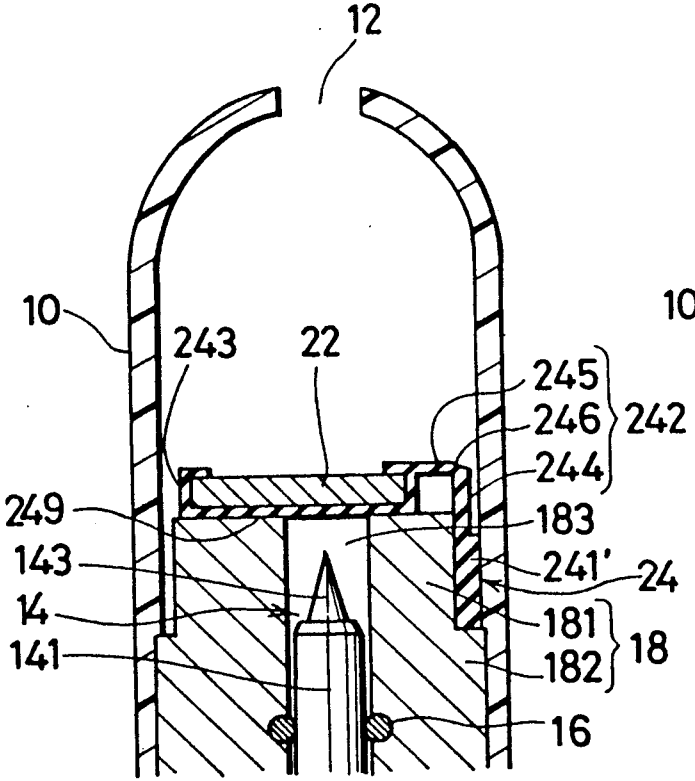

Next, a fourth embodiment will be described with reference to FIGS. 8(*a*) and 8(*b*) and FIG. 9.

In this embodiment, the connecting member 24 comprises a lower fitting portion 241' in the form of a bar or plate and inserted between the outer surface of the small-diameter portion 181 of the sleeve 18 and the inner surface of the container 10, and an upper fitting portion 243 in the form of a shallow container with a bottom wall 249. The closure 22 is in the form of a disk and is fitted in the upper fitting portion 243 as enclosed therein.

With the construction described, the closure 22 is attached to the sleeve 18 by a magnetic force penetrating through the bottom wall 249 of the connecting member 24, thereby holding the bottom wall 249 in contact with the forward end face of the sleeve 18, whereby the bore 183 is sealed. In this case, the bottom wall 249 also has such a small thickness that the magnetic force of the closure 22 will reach the sleeve 18.

Next, a fifth embodiment will be described with reference to FIGS. 10(*a*) and 10(*b*).

In this embodiment, a disklike closure 23 and a connecting member 24, like those of some of the foregoing embodiments, are integrally formed of rubbernet, and the main portion of the sleeve 18 is made of a nonmagnetic material such as synthetic resin or rubber. To an inner surface of the main portion of the sleeve 18 is fitted an attracting member 25 made of stainless steel or like magnetic material and centrally formed with a bore extending therethrough. The closure 23 is attracted by the attracting member 25 with a thin wall portion of the sleeve 18 positioned therebetween. The container 10 included in each of the above embodiments is omitted from this embodiment, and the side surface of the sleeve 18 is left exposed as the surface of the writing implement. A tubular forward body 26 is fitted to a stepped portion 186 formed in the sleeve 18 at its upper end portion.

As will be apparent from the present embodiment, the closure and the connecting member of the writing implement of the present invention are not always separate pieces but may be integral with each other. This embodiment has the same advantages as the foregoing embodiments.

Next, a sixth embodiment will be described with reference to FIGS. 11(*a*) and 11(*b*).

In this embodiment, the main portion of the sleeve 18 is made of a nonmagnetic material such as synthetic resin or rubber, and an attracting member 25 similar to the one used in the fifth embodiment is secured to the upper end of the sleeve 18. The closure 22 fitted in the connecting member 24 as in the fourth embodiment is attracted by the attracting member 25. A seal portion 185 in contact with the refill 14 is formed on the inner surface of the sleeve 18 integrally therewith.

As will be apparent from the sixth and fifth embodiments, the sleeve 18 need not be made of a magnetic material in its entirety insofar as the forward end portion thereof to be brought into contact with the closure is formed of a magnetic material. For example, to the forward end surface of the main portion of the sleeve 18 may be secured an attracting member having substantially the same sectional shape as the main portion of the sleeve 18.

The present invention is not limited to the above embodiments but can be embodied, for example, as will be described below.

Figure 10B:
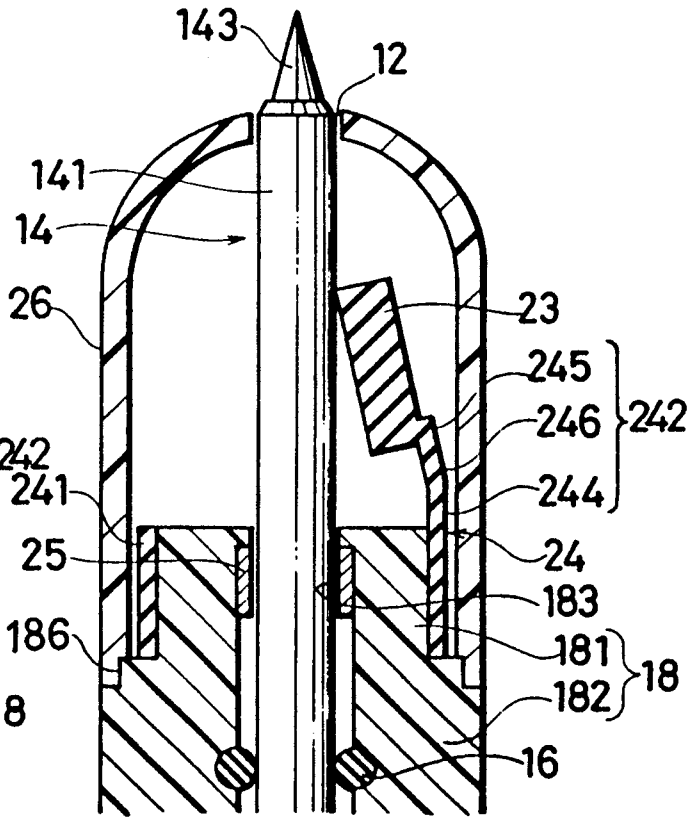
FIG. 10(*a*) is a sectional view showing another writing implement as a fifth embodiment with its barrel in a stowed position.
Figure 10A:
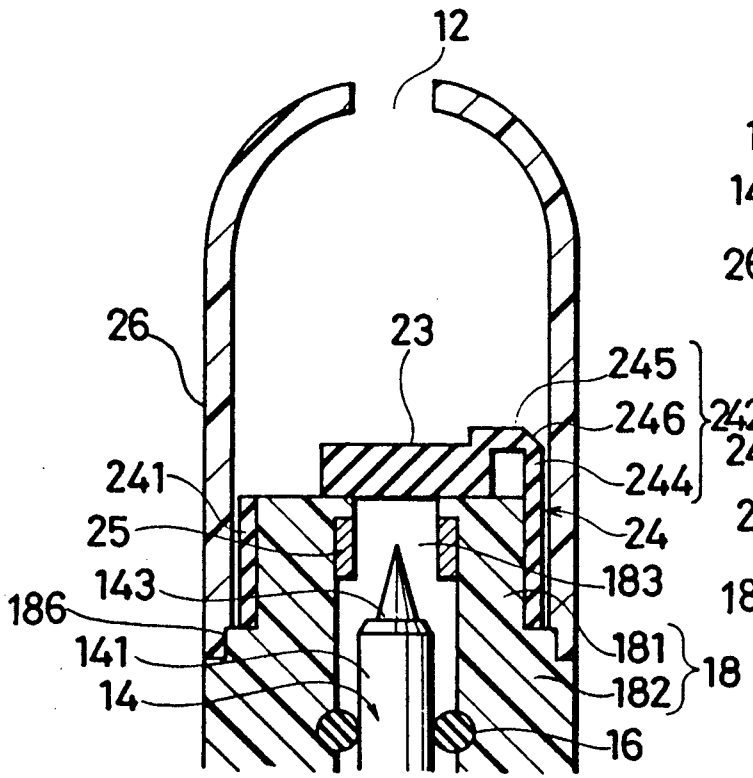
Figure 11:
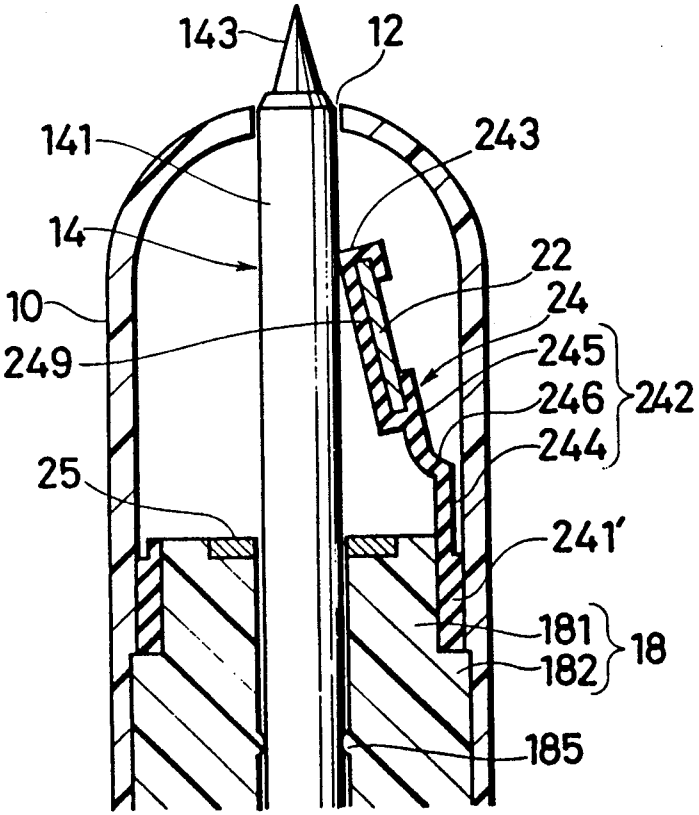
FIG. 11(*a*) is a sectional view showing another writing implement as a sixth embodiment with its barrel in a stowed position.
Figure 11:
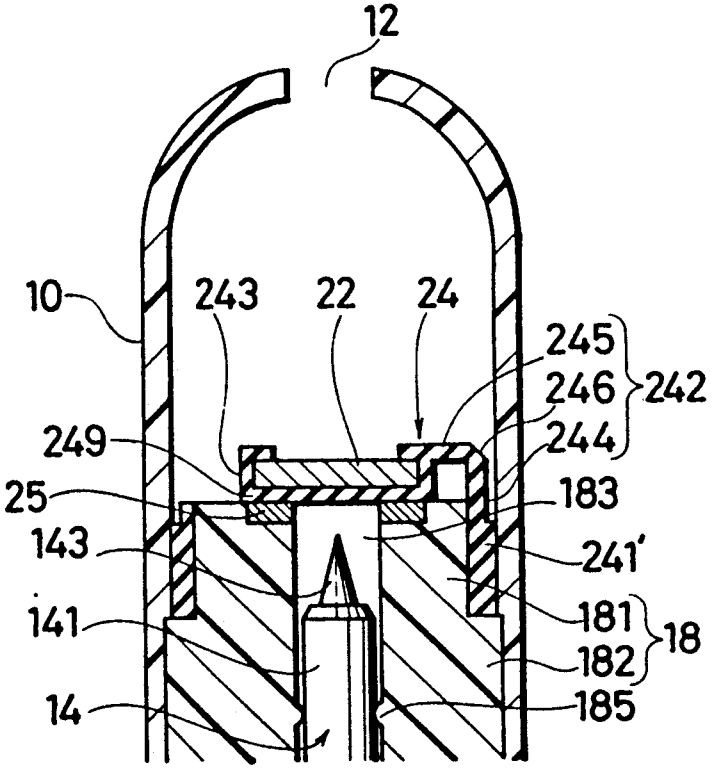

(1) According to the foregoing embodiments, the sleeve 18 in its entirety or the forward end portion thereof is made of a magnetic material, with the closure 22 or 23 formed by a magnet, whereas the sleeve 18 may be formed by a magnet in its entirety, or the attracting member 25 shown in FIG. 10 or 11 may be formed by a magnet. In the case where the attracting member 25 in the construction of FIG. 10 is formed by a magnet, the closure 23 and the connecting member 24 may be integrally formed by rubbernet, or by a rubber or the like containing a finely divided magnetic material dispersed therein. The same advantages as already described can then be obtained.

Furtheremore, at least the forward end portion of the sleeve and the closure may each be formed by a magnet. In this case, these two members are made different in magnetic polarity at the portions thereof to be brought into contact with each other.

(2) In the case where the closure 22 is brought into direct contact with the sleeve 18 as in the first embodiment, a sealing agent such as vaseline, grease or liquid paraffin may be applied to the portions thereof to be in contact with each other (i.e., to the seal portions). This produces an enhanced sealing effect.

(3) According to the invention, the elastic material for forming the connecting member is not limited specifically insofar as the member is elastically deformable to such an extent as to greatly move the closure. To reduce the load acting on the writing tip 143 when the refill 14 is projected, however, it is desirable to use a material which is lower in modulus of elasticity.

(4) The writing implement of the present invention is not limited to ballpoint pens, cosmetic applicators, marking pens such as sign pens, plastic pens, paint markers, or the like in the narrow sense of the term but includes a wide variety of implements for applying a desired ink, liquid or composition to desired portions or articles, such as applicators for use with glue, adhesive, eraser composition or cosmetics.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A writing implement having a sleeve formed with a bore extending therethrough axially of the implement, a barrel inserted in the bore of the sleeve and retractably projectable forward from the forward end of the sleeve, and a closure so shaped as to close the forward end opening of the bore of the sleeve, the writing implement being characterized in that at least the forward end portion of the sleeve and the closure are made of a magnetic material, at least one of the sleeve forward end portion and the closure being formed by a magnet so as to attract the other, the closure being connected to the sleeve by a connecting member made of an elastic material so as to be movable between a position where the closure closes the forward end opening of the sleeve bore and position where the closure opens the forward end opening to permit the barrel to project forward, the closure being biased by the connecting member toward the sleeve to a position where the closure is attractable by the sleeve.

2. A writing implement as defined in claim 1 wherein the sleeve is formed by the magnet.

3. A writing implement as defined in claim 1 wherein the sleeve includes a main portion and the magnet secured to the forward end of the main portion.

4. A writing implement as defined in claim 1 wherein the closure is formed by the magnet.

5. A writing implement as defined in claim 4 wherein the sleeve includes a main portion made of a nonmagnetic material, and an attracting member made of a magnetic material and secured to the forward end of the main portion.

6. A writing implement as defined in claim 1 wherein at least the forward end portion of the sleeve and the closure are each formed by the magnet and are made different in magnetic polarity at the portions thereof to be brought into contact with each other.

7. A writing implement as defined in claim 1 wherein the connecting member is made of rubber.

8. A writing implement as defined in any one of claims 4 to 6 wherein the closure and the connecting member are molded integrally of rubbernet.

9. A writing implement as defined in any one of claims 4 to 6 wherein the closure and the connecting member are molded integrally of a rubber containing a finely divided magnetic material as dispersed therein.

10. A writing implement as defined in claim 1 wherein the connecting member comprises a lower fitting portion fitted to the sleeve, an upper fitting portion fitted to the closure, and a connector for connecting the lower fitting portion to the upper fitting portion.

11. A writing implement as defined in claim 10 wherein the lower fitting portion is tubular.

12. A writing implement as defined in claim 10 wherein the lower fitting portion is in the form of a cap having a top wall, and the top wall is formed with a hole in conformity with the bore of the sleeve.

13. A writing implement as defined in claim 10 wherein the lower fitting portion is shaped in the form of a bar or plate and inserted between the outer surface of the sleeve and the inner surface of the body of the implement.

14. A writing implement as defined in claim 10 wherein the upper fitting portion is tubular.

15. A writing implement as defined in claim 10 wherein the upper fitting portion is in the form of a container having a bottom wall, and the closure is enclosed and fitted in the upper fitting portion.

16. A writing implement as defined in claim 10 wherein the connector comprises an upward portion extending upward from the upper end of the lower fitting portion, and an inward portion extending inward from the upper end of the upward portion, and the inner end of the inward portion is integral with the upper fitting portion.

17. A writing implement as defined in claim 16 wherein the connector is so formed that the upward portion and the inward portion are approximately at a right angle with each other when free of any external force.

18. A writing implement as defined in claim 17 wherein the junction of the upward portion and the inward portion is a corner portion having a tapered face.

19. A writing implement as defined in any one of claims 1, 10 and 14 wherein the closure comprises an upper portion in the form of solid cylinder and fitted to the connecting member, and a lower portion extending downward from the upper portion in a flaring form, the lower portion being substantially larger at its bottom than the bore of the sleeve.

20. A writing implement as defined in claim 1 wherein a recess is formed in the lower end face of the closure.

21. A writing implement as defined in claim 19 wherein a recess is formed in the lower end face of the closure.

22. A writing implement as defined in any one of claims 1, 10 and 11 wherein the closure is in the form of a rigid ball, and the peripheral edge of the sleeve defining the forward end opening of the bore is formed with a tapered face for contact with the closure.

23. A writing implement as defined in claim 12 wherein the closure is in the form of a rigid ball, and the peripheral edge of the top wall of the lower fitting portion defining the hole at the outer end thereof is formed with a tapered face for contact with the closure.

24. A writing implement as defined in claims 1 or 15 wherein the closure is in the form of a plate.

25. A writing implement as defined in any one of claims 1, 10 and 14 wherein a sealing agent is applied to the closure and the sleeve at the portions to be in contact with each other.

26. A writing implement as defined in claim 19 wherein a sealing agent is applied to the closure and the sleeve at the portions thereof to be in contact with each other.

27. A writing implement as defined in claim 1 wherein the barrel has a liquid storage portion for containing liquid, and a passage for communicating the liquid storage portion with a closing space formed between the forward end portion of the barrel and the sleeve.

28. A writing implement as defined in claim 1 wherein a sealing member is secured to an inner surface of the sleeve, the sealing member being in contact with the barrel.

29. A writing implement as defined in claim 1 wherein a sealing portion is formed integrally with an inner surface of the sleeve, the sealing portion being in contact with the barrel.

* * * * *